US007993192B2

(12) United States Patent
Moshal

(10) Patent No.: US 7,993,192 B2
(45) Date of Patent: Aug. 9, 2011

(54) CONTROL SYSTEM

(76) Inventor: Martin Moshal, Marina Bay (GI)

( * ) Notice: Subject to any disclaimer, the term of this patent is extended or adjusted under 35 U.S.C. 154(b) by 1120 days.

(21) Appl. No.: 10/504,313

(22) PCT Filed: Feb. 12, 2003

(86) PCT No.: PCT/IB03/00453

§ 371 (c)(1),
(2), (4) Date: Mar. 16, 2005

(87) PCT Pub. No.: WO03/068349

PCT Pub. Date: Aug. 21, 2003

(65) Prior Publication Data

US 2005/0181854 A1 Aug. 18, 2005

(30) Foreign Application Priority Data

Feb. 14, 2002 (GB) ..... 0203519.4

(51) Int. Cl.
*A63F 9/24* (2006.01)

(52) U.S. Cl. ..... 463/16; 463/25

(58) Field of Classification Search ..... 463/16, 463/24, 25, 29, 42, 43
See application file for complete search history.

(56) References Cited

U.S. PATENT DOCUMENTS 4,856,787 A 8/1989 Itkis
5,046,736 A 9/1991 Bridgeman et al.
5,324,035 A 6/1994 Morris et al.
5,762,552 A 6/1998 Vuong
6,012,983 A * 1/2000 Walker et al. ..... 463/20
(Continued)

FOREIGN PATENT DOCUMENTS

WO 01/48713 A1 7/2001
(Continued)

OTHER PUBLICATIONS

Supplementary European Search Report, dated May 21, 2007, from related application, EP 03 70 2852.

*Primary Examiner* — David L Lewis
*Assistant Examiner* — Robert Mosser
(74) *Attorney, Agent, or Firm* — McDonnell Boehnen; Hulbert & Berghoff LLP

(57) ABSTRACT

A control system (1) for an online casino game has a man-machine interface (FIG. 1) operable by a player to regulate the progress of the game, and includes a switch means (8) operable by the player to selectively switch the man-machine interface between two modes in which the player may regulate the progress of the particular game. The two modes are a regular mode in which the interface is of a predetermined complexity, and an expert mode in which the interface is of an increased complexity relative to that of the regular mode. The control system is activatable by the player to automatically regulate the progress of a selectable number of consecutive turns of the game without further intervention from the player. The automatic progress of the consecutive turns of the game is interruptible by the player at anytime before completion thereof. The configuration facility is also configurable to cause the selected number of consecutive turns of the game to progress automatically until all the turns are complete, or to terminate upon winning of a jackpot prize available for the casino game, alternatively upon occurrence of a successful wager, further alternatively upon occurrence of a success wager exceeding a predetermined threshold, still further alternatively upon occurrence of a wager that causes a bankroll of the player to change by more than a predetermined amount.

18 Claims, 2 Drawing Sheets

U.S. PATENT DOCUMENTS

| | | | |
|---|---|---|---|
| 6,099,408 | A | 8/2000 | Schneier et al. |
| 6,104,815 | A | 8/2000 | Alcorn et al. |
| 6,110,041 | A | 8/2000 | Walker et al. |
| 6,117,013 | A | 9/2000 | Eiba |
| 6,375,568 | B1 | 4/2002 | Roffman et al. |
| 6,508,710 | B1 | 1/2003 | Paravia et al. |
| 6,575,834 | B1 | 6/2003 | Lindo |
| 2001/0041612 | A1 | 11/2001 | Garahi et al. |
| 2002/0142825 | A1 | 10/2002 | Lark et al. |
| 2002/0151366 | A1 | 10/2002 | Walker et al. |
| 2002/0169016 | A1 | 11/2002 | Tarantino |

FOREIGN PATENT DOCUMENTS

| | | | |
|---|---|---|---|
| WO | 01/51147 | A1 | 7/2001 |

* cited by examiner

CONTROL SYSTEM

FIELD OF THE INVENTION

This invention relates to a control system and, more particularly, to a control system which can be employed to regulate the progress of a game, in particular a casino game. The invention extends to a method of controlling a game.

BACKGROUND TO THE INVENTION

An electronic casino game provides a player of such a game with a man-machine interface ("MMI"). Where the electronic casino game is embodied in an electronic machine of a type that is commonly encountered in land-based casinos, the MMI comprises a combination of a video display screen and one or more push buttons that are used by the player to control the progress of the game. If the casino game is an online game, the MMI comprises a video display screen with one or more icons displayed thereon that are individually activatable by means of a pointing device such as a mouse, a touchpad or the like.

By their very nature, electronic casino games require a MMI that is simple enough to be used by inexperienced players. Such a simple interface is, however, problematic for game developers, as it inhibits the addition of new features to the electronic casino game without increasing the complexity of the interface. The game developers are thus required to compromise between simplicity of the interface and increased functionality and control of the casino game.

Many games that are played at land-based or online casinos are repetitive in nature and consist, generally, of repeated cycles of the following steps: making a wager, generating one or more random events, determining whether or not the wager is successful as a function of the generated random events, collecting the wager if unsuccessful, and paying the wager according to predetermined odds if the wager is successful. Examples of such repetitive games are roulette, blackjack, video poker and slots.

Such repetition can rapidly become tedious to a player of the game and can quickly lead to boredom with consequent loss of interest in the game. This is particularly so in casino games, where the outcome of the game depends on pure chance, and is not dependent on strategy, such as, for example, the game of slots.

OBJECT OF THE INVENTION

It is an object of this invention to provide a control system for a casino game, and a method of controlling the casino game that will, at least partially, enable an experienced player to play the game in an advanced manner in which the necessity of undertaking repetitive actions or tasks is reduced relative to prior art systems.

It is a further object of this invention to provide a control system for a casino game, and a method of controlling the casino game that will, at least partially, allow the progress of the game to be speeded up relative to a conventional manner in which the game is played.

It is a still further object of this invention to provide a control system for a casino game, and a method of controlling the casino game that will, at least partially, enable an operator of the game to speed up a rate at which successive turns of the game can be played, in order to increase a turnover of wagers that are made on the game.

SUMMARY OF THE INVENTION

In accordance with this invention there is provided a control system for a casino game having a man-machine interface operable by a player of the casino game to regulate the progress of the game, the man-machine interface including a switch means operable by the player to selectively switch the man-machine interface between any one of at least two modes in which the player may regulate the progress of the particular game.

Further features of the invention provide for a first one of the at least two modes of the man-machine interface to be a regular mode in which the man-machine interface is of a predetermined complexity, and for a second one of the at least two modes of the man-machine interface to be an expert mode in which the man-machine interface is of an increased complexity relative to that of the regular mode.

Still further features of the invention provide for the casino game to be an online casino game, for the control system to include a computer workstation operating under control of a software program, the computer workstation having a display monitor and being communicable with a gaming server remote from the workstation, for the switch means to be an icon displayable on the display monitor, the icon being activatable by the player to cause the man-machine interface to switch to a different one of the at least two modes.

Yet further features in the invention provide for the casino game to include any one of roulette, blackjack, video poker or slots.

The invention extends to a control system for regulating the progress of a casino game, the control system being activatable by the player to automatically regulate the progress of a plurality of turns of the game without further intervention from the player.

There is further provided for the control system to be activatable to automatically regulate the progress of a plurality of consecutive turns of the game without further intervention from the player, for the casino game to be an online casino game, for the control system to include a computer workstation operating under control of a software program, the computer workstation being communicable with a gaming server remote from the workstation, for the software program to provide a configuration facility configurable to cause five, alternatively 10, further alternatively a different selectable number of consecutive turns of the game to progress automatically without intervention from the player, and for the automatic progress of the consecutive turns of the game to be selectively interruptible by the player.

There is still further provided for the configuration facility to be configurable to cause the selected number of consecutive turns of the game to progress automatically until all the turns are complete, alternatively for the selectable number of consecutive turns of the game to terminate upon winning of a jackpot prize available for the casino game, further alternatively for the selectable number of consecutive turns of the game to terminate upon occurrence of a successful wager, still further alternatively for the selectable number of consecutive turns of the game to terminate upon the occurrence of a successful wager exceeding a predetermined threshold, yet further alternatively for the selectable number of consecutive turns of the game to terminate upon the occurrence of a wager that causes a bankroll of the player to change by more than a predetermined amount.

There is also provided for the casino game to include any one of roulette, blackjack, video poker, or slots.

The invention extends still further to a method of controlling a casino game having a man-machine interface usable by a player of the casino game to regulate the progress of the game, the method including a step of selectively switching the man-machine interface between any one of at least two modes in which the player may regulate the progress of the particular game.

There is further provided for selectively switching the man-machine interface between a regular mode in which the man-machine interface is of a predetermined complexity, and an expert mode in which the man-machine interface is of an increased complexity relative to that of the regular mode.

There is still further provided for the casino game to be an online casino game, and for selectively switching the man-machine interface between any one of the at least two modes by activating an icon displayed on a display monitor of a computer workstation operating under control of a software program and being communicable with a gaming server remote from the workstation.

The invention extends yet further to a method of regulating the progress of a casino game, the method including the step of activating the control system to automatically regulate the progress of a plurality of turns of the game without further intervention by the player.

There is further provided for automatically regulating the progress of a plurality of consecutive turns of the game without further intervention from the player, for the method to include the further step of configuring a configuration facility to cause five, alternatively 10, further alternatively a different selectable number of consecutive turns of the game to progress automatically without intervention by the player, and for selectively interrupting the automatic progress of the consecutive turns of the game.

There is still further provided for configuring the configuration facility to cause the selected number of consecutive turns of the game to progress automatically until all the turns are complete, alternatively to cause the selectable number of consecutive turns of the game to terminate upon winning of a jackpot prize available for the casino game, further alternatively to cause the selectable number of consecutive turns of the game to terminate upon occurrence of any successful wager, still further alternatively to cause the selectable number of consecutive turns of the game to terminate upon the occurrence of a successful wager exceeding a predetermined threshold, yet further alternatively to cause the selectable number of consecutive turns of the game to terminate upon the occurrence of a wager that causes a bankroll of the player to change by more than a predetermined amount.

BRIEF DESCRIPTION OF THE DRAWINGS

A preferred embodiment of the invention is described below, by way of example only, and with reference to the accompanying drawing in which.

DETAILED DESCRIPTION OF THE INVENTION

Figure 1:
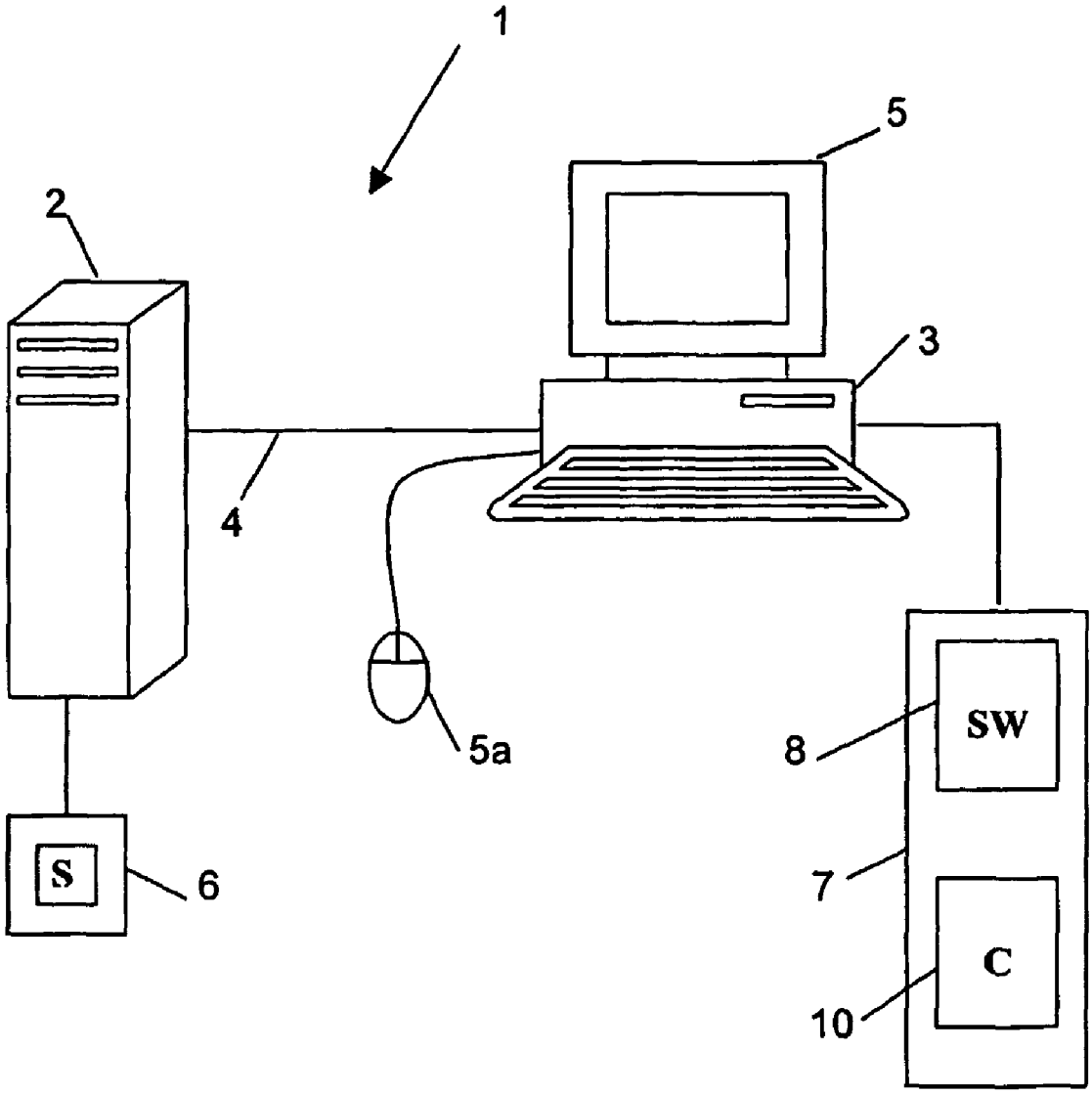
FIG. 1 is a schematic representation of a control system according to the invention.
Figure 2:
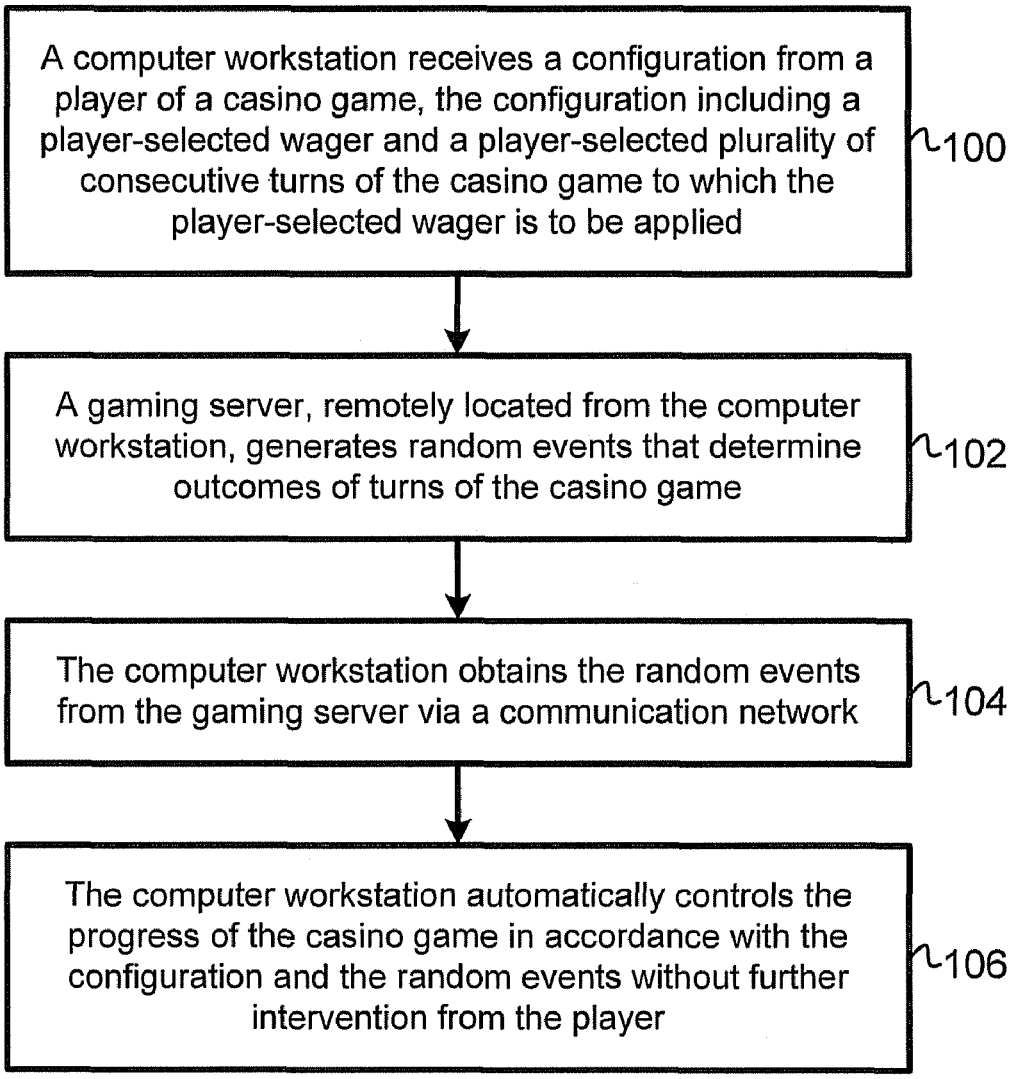
FIG. 2 is a flow chart illustrating a method of regulating the progress of a casino game, according to the invention. A computer workstation receives a configuration from a player of the casino game, the configuration including a player-selected wager and a player-selected plurality of consecutive turns of the casino game to which the player-selected wager is to be applied (block 100). A gaming server, remotely located from the computer workstation, generates random events that determine outcomes of turns of the casino game (block 102). The computer workstation obtains the random events from the gaming server via a communication network (block 104). The computer workstation automatically controls the progress of the casino game in accordance with the configuration and the random events without further intervention from the player (block 106).

Referring to FIG. 1, a control system for a casino game is indicated generally by reference numeral (1).

The control system (1) includes a gaming server (2) and a player access facility (3) in the form of a computer workstation with an associated display monitor (5) and a pointing device (5*a*), such as a mouse or, alternatively, a touchpad. The computer workstation (3) is located remotely from the gaming server (2) and communication between the computer workstation and the gaming server is provided across a communication network (4) that is, in this embodiment, the Internet.

The computer workstation (3) is a conventional personal computer operating under a Windows 2000 operating system, which is well known and commercially available from the Microsoft Corporation of Seattle, Wash., USA. The gaming server (2) also operates under the Windows 2000 operating system. The computer workstation (3) executes a client process (7) in the form of a computer program that includes a simulation of a casino game. The client process (7) executes under instruction of a player by means of a MMI (not shown) on the computer workstation (3). The gaming server (2) executes a server process (6), which is another computer program that generates one or more random events that determine the outcome of the casino game. The operation of the client and server processes (7 and 6) will be described in greater detail in the description that follows. This embodiment of the invention will be described with particular reference to a casino game of video slots. It is to be clearly understood, however, that the scope of this invention is not limited to this particular casino game.

The video slots casino game consists of the server process (6), which is executable in the gaming server (2), and the corresponding client process (7), which is executable in the computer workstation (3). The server process (6) generates, upon request of the client process (7), a random event that is, in this embodiment, the spin of three wheels of a slot machine, on which an outcome of the game of video slots is based. The client process (7) obtains the result of the random event from the gaming server (2), across the communication network (4) and displays the random event to a player on the display monitor (5) in an intelligible manner, by simulating on the monitor an animation of three spinning reels that come to rest at appropriate indexed positions corresponding to the outcome of the random event.

The client process (7) also allows the player to make wagers on a turn of the game of video slots, and to effect decisions which determine the progress of the game, as will be described in the description that follows. The MMI comprises different page images that are displayed on the display screen (5) under control of the client process (7), in combination with the pointing device (5*a*). The client process (7) outputs information and data to the player by rendering an appropriate page image on the display screen (5). Any page image will include one or more clickable icons displayed on the display screen (5). The player inputs data to the client process (7) by utilising the pointing device to activate one or more of the clickable icons.

All of the different page images rendered on the display screen (5) include a switch means (8) in the form of a clickable icon that can be selectively activated by the player to toggle the MMI between either one of two modes. A first one of the two modes of the MMI is a regular mode in which the interface is of a predetermined complexity, the complexity being proportional to a number of clickable icons that are presented to the player for regulating the progress of the game of video slots. A second one of the two modes of the MMI is an expert mode in which the interface is of increased complexity relative to that of the regular mode, with a larger number of clickable icon presented to the player. The increased number of icons can be used to provide the player with additional game functionality relative to that available in the regular mode. Inexperienced players of the game of video slots may choose to play the game with a simpler interface by switching the MMI to the regular mode, in which more advanced gameplay features are not available to the player.

It will be appreciated by those skilled in the art that such a multi-mode interface for a casino games enables the provision of a simple interface for inexperienced players, without sacrificing the provision of additional game functionality and control for more experienced players.

Numerous modifications are possible to this embodiment without departing from the scope of the invention. In particular, the control system (1) is directly applicable to present a player with a switchable multi-mode MMI for casino games other than video slots, such as the games of roulette, blackjack or video poker, for example. Further, the MMI may be selectively switchable by a player between any three or more modes, as opposed to the two modes described above.

As described above, the expert mode can be used to provide the player with additional game functionality relative to that available in the regular mode.

One example of the application of the regular and expert modes of a MMI will be described below. In the regular mode the player is able to control the progress of each consecutive turn of the casino game individually, as is well known in the prior art. In this mode, the player is required to decide on an appropriate size of wager on each consecutive turn of the game, and to explicitly initiate generation of the random event for each individual turn of the game.

In the expert mode (or "autoplay" mode) the player is able to automatically control the progress of a plurality of consecutive turns of the game without further intervention. In this mode, the client process (7) provides the player with a configuration facility (10) that can be configured by the player to automatically control the progress of the plurality of consecutive turns of the game.

In use, when the player has switched the mode of the game from the regular mode to the expert mode, the player configures the configuration facility (10) as follows:

1. The player determines the size of a wager which he wishes to apply uniformly to each of the plurality of consecutive turns of the game;
2. The player then selects either five, 10, or another desired number of consecutive turns of the game which he desires to play without any further intervention;
3. Upon completion of the configuration, the player initiates execution of the desired number of consecutive turns of the game, and execution of the consecutive turns is performed sequentially, without any intervention by the player, until the desired number of turns of the game has been completed.

At any time during execution of the desired number of consecutive turns of the game, the player is able to manually interrupt execution by activating a "Stop" icon (not shown) that is displayed by the client process (7) on the display screen (5). After activation of the Stop icon, execution of the current turn of the game is completed, any remaining turns of the game that have been configured are not executed, and the client process switches the MMI to the regular mode.

The configuration facility (10) is also configurable to cause execution of the desired number of consecutive turns of the game to be automatically terminated upon occurrence of any one of the following events:

- a wager which wins a jackpot prize available for the casino game. The jackpot may be a static one or, alternatively, a progressive one;
- any successful wager;
- a successful wager which returns winnings which exceed a predetermined threshold; or
- a wager, whether successful or unsuccessful, which alters the player's bankroll by an amount in excess of a predetermined threshold.

It will be appreciated by those skilled in the art that the control system (1) of the invention enables an experienced player of a casino game to configure the operation of the game to permit an advanced mode of play in which the necessity of undertaking repetitive actions or tasks is minimised, the so-called auto play mode, and in which the progress of the game is speeded up relative to a conventional manner in which the game is played, without requiring manual intervention from the player. It will be further appreciated by those skilled in the art that the autoplay feature described above need not be used in combination with a man-machine interface switchable between a regular and an expert mode, but can, instead be independently applied to control the progress of the game without the necessity of providing the player with a corresponding facility for switching a mode of the man-machine interface.

Numerous modifications are possible to this embodiment without departing from the scope of the invention. In particular, the control system (1) is directly applicable to control the play of casino games other than slots, such as roulette, blackjack or video poker, for example. Further, the control system (1) can be applied to control the progress of games in self-contained apparata that do not operate in an on-line environment, such as electronic gaming devices of a type commonly found in land-based casinos, or hand-held gaming devices. Still further, instead of the application of a uniformly sized wager to each of the plurality of consecutive turns of the game, the size of the wager may be determined as a function of game play strategy applied automatically during the plurality of consecutive turns. Yet further, the control system (1) may be applied in conjunction with, or without, programmed decision-making.

The technical problem solved by this invention is that of extending the functionality of a man-machine interface through the provision of a switchable multi-modal graphical user interface. The invention enables increased functionality to be dissociated from increased complexity of the graphical user interface through the use of additional, switchable modes of operation.

A further technical problem solved by the invention is that of automating the execution of several cycles of a repetitive game by configuring a control system as to a desired number of cycles of the game that are to execute without intervention from a player of the game, together with early stopping to terminate execution of the game prior to completion of the desired number of cycles.

The invention therefore provides a control system that allows a user of the system to control the progress of successive turns of the game in a flexible manner.

The invention claimed is:

1. A control system for a casino game, comprising:

a gaming server programmed to generate random events that determine outcomes of turns of the casino game;

a computer workstation located remotely from the gaming server and communicable with the gaming server via a communication network, the computer workstation programmed to perform the steps of:

receiving a configuration from a player of the casino game, (ii) obtaining the random events from the gaming server via the communication network, and (iii) automatically controlling the progress of the casino game in accordance with the configuration and the random events without further intervention from the player, the configuration including a player-selected wager and a player-selected plurality of consecutive turns of the casino game to which the player-selected wager is to be applied.

2. A control system as claimed in claim 1, wherein the computer workstation has a display monitor operable to display the progress of the casino game.

3. A control system as claimed in claim 1, wherein the configuration includes at least one player-selected termination condition upon which execution of the player-selected plurality of consecutive turns of the casino game is to be automatically terminated.

4. A control system as claimed in claim 3, wherein the at least one player-selected termination condition includes winning of a jackpot prize available for the casino game.

5. A control system as claimed in claim 3, wherein the at least one player-selected termination condition includes occurrence of a successful wager.

6. A control system as claimed in claim 3, wherein the at least one player-selected termination condition includes occurrence of a successful wager exceeding a predetermined threshold.

7. A control system as claimed in claim 3, wherein the at least one player-selected termination condition includes occurrence of a wager that causes a bankroll of the player to change by more than a predetermined amount.

8. A control system as claimed in claim 1, wherein the automatic progress of the player-selected plurality of different turns of the casino game is selectively interruptible by the player.

9. A control system as claimed in claim 1, wherein the casino game includes any one of roulette, blackjack, video poker, or slots.

10. A method of regulating the progress of a casino game, comprising the steps of:

computer workstation receiving a configuration from a player of the casino game, the configuration including a player-selected wager and a player-selected plurality of consecutive turns of the casino game to which the player-selected wager is to be applied;

a gaming server, remotely located from the computer workstation, generating random events that determine outcomes of turns of the casino game;

the computer workstation obtaining the random events from the gaming server via a communication network; and the computer workstation automatically controlling the progress of the casino game in accordance with the configuration and the random events without further intervention from the player.

11. A method as claimed in claim 10, further comprising the step of:

displaying the progress of the casino game on a display monitor of the computer workstation.

12. A method as claimed in claim 10, wherein the configuration includes at least one player-selected termination condition, further comprising:

automatically terminating execution of the player-selected plurality of consecutive turns of the casino game upon occurrence of the at least one player-selected termination condition.

13. A method as claimed in claim 12, wherein the at least one player-selected termination condition includes winning of a jackpot prize available for the casino game.

14. A method as claimed in claim 12, wherein the at least one player-selected termination condition includes a successful wager.

15. A method as claimed in claim 12, wherein the at least one player-selected termination condition includes a successful wager exceeding a predetermined threshold.

16. A method as claimed in claim 12, wherein the at least one player-selected termination condition includes a wager that causes a bankroll of the player to change by more than a predetermined amount.

17. A method as claimed in claim 10, further comprising the step of:

the player selectively interrupting the automatic progress of the player-selected plurality of different turns of the casino game.

18. A method as claimed in claim 10, wherein the casino game includes any one of roulette, blackjack, video poker, or slots.

* * * * *

UNITED STATES PATENT AND TRADEMARK OFFICE

CERTIFICATE OF CORRECTION

PATENT NO. : 7,993,192 B2
APPLICATION NO. : 10/504313
DATED : August 9, 2011
INVENTOR(S) : Martin Moshal It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1184 days.

Signed and Sealed this
Twenty-second Day of November, 2011

David J. Kappos

David J. Kappos
*Director of the United States Patent and Trademark Office*